US010221847B2

(12) United States Patent
Dyer

(10) Patent No.: US 10,221,847 B2
(45) Date of Patent: Mar. 5, 2019

(54) FLUID END ASSEMBLY WITH MODIFIED SUCTION BLOCK

(71) Applicant: Dewey Francis Dyer, Spring, TX (US)

(72) Inventor: Dewey Francis Dyer, Spring, TX (US)

(73) Assignee: FIRSTEX INDUSTRIES, INC., Grand Prairie, TX (US)

( * ) Notice: Subject to any disclaimer, the term of this patent is extended or adjusted under 35 U.S.C. 154(b) by 893 days.

(21) Appl. No.: 14/222,529

(22) Filed: Mar. 21, 2014

(65) Prior Publication Data

US 2014/0286805 A1 Sep. 25, 2014

Related U.S. Application Data

(60) Provisional application No. 61/852,762, filed on Mar. 21, 2013.

(51) Int. Cl.

| | |
|---|---|
| ***F04B 53/00*** | (2006.01) |
| ***F04B 49/22*** | (2006.01) |
| ***F04B 39/12*** | (2006.01) |
| ***F04B 39/10*** | (2006.01) |

(52) U.S. Cl.
CPC ..... *F04B 49/22* (2013.01); *F04B 39/10* (2013.01); *F04B 39/12* (2013.01)

(58) Field of Classification Search
CPC .... F04B 49/22; F04B 53/1022; F04B 53/109; Y10T 137/7842
See application file for complete search history.

(56) References Cited

U.S. PATENT DOCUMENTS

| | | | | |
|---|---|---|---|---|
| 3,228,348 | A | 1/1966 | Wilson | |
| 3,260,217 | A | 7/1966 | Thresher | |
| 4,122,867 | A * | 10/1978 | Zagotta | F16K 11/0708 137/625.3 |
| 4,553,298 | A | 11/1985 | Grable | |
| 4,724,862 | A * | 2/1988 | Chamberlain | F16T 1/00 137/203 |
| 4,861,241 | A | 8/1989 | Gamboa et al. | |
| 4,878,815 | A | 11/1989 | Stachowiak | |
| 5,037,276 | A * | 8/1991 | Tremoulet, Jr. | F04B 53/1022 137/312 |
| 5,253,987 | A | 10/1993 | Harrison | |
| 5,846,056 | A | 12/1998 | Dhindsa et al. | |
| 6,544,012 | B1 * | 4/2003 | Blume | F04B 53/007 277/370 |
| 7,335,002 | B2 | 2/2008 | Vicars | |
| 7,341,435 | B2 | 3/2008 | Vicars | |
| 7,350,534 | B2 * | 4/2008 | Riley | F16K 15/044 137/15.22 |

(Continued)

*Primary Examiner* — Dominick L Plakkoottam
(74) *Attorney, Agent, or Firm* — Alvin R. Wirthlin

(57) ABSTRACT

A suction block for use in a fluid end assembly of a high pressure reciprocal pump includes a first suction bore extending from a first face of the suction block and into the interior thereof; and a second suction bore extending from a second face of the suction block and into the interior thereof to intersect the first suction bore. The second suction bore is adapted to receive a valve assembly for alternatively fluidly connecting and disconnecting the first and second suction bores. The first suction bore has a first suction bore section with a first geometry and a second suction bore section with a second geometry different from the first geometry to thereby reduce stress in the suction block during use.

17 Claims, 7 Drawing Sheets

(56) References Cited

U.S. PATENT DOCUMENTS

| | | | | |
|---|---|---|---|---|
| 8,105,055 | B2 | 1/2012 | Small | |
| 2004/0108000 | A1 * | 6/2004 | Raghavan | F04B 53/1032 137/540 |

* cited by examiner

FLUID END ASSEMBLY WITH MODIFIED SUCTION BLOCK

CROSS-REFERENCE TO RELATED APPLICATIONS

This application claims the benefit of U.S. Provisional Application No. 61/852,762 filed on Mar. 21, 2013, the disclosure of which is hereby incorporated by reference.

BACKGROUND OF THE INVENTION

The present invention relates generally to high pressure pumps, and more particularly to the fluid end of such pumps.

High-pressure reciprocating fluid pumps have been used for many years in various industries to pressurize incompressible fluids to pressures upwards of 10 kpsi. A primary use of such pumps is for pumping drilling fluid downhole, such as mud, during oil well drilling. Such pumps are also used to provide pressurized fluid for fracking operations, water-blasting, slurry transport for oil fields, coal slurry transport from a mine to a power station, and other applications where liquids with high solid content must be transported from one location to another.

Because of the cyclic pressures (atmospheric to 10 kpsi or more) of these high pressure reciprocating fluid pumps, and the use of abrasive process fluids, the operating environment of such pumps is very demanding. Because of the high cyclical pressures encountered in the fluid end portions of these pumps, their components, such as the suction module and valves are susceptible to fatigue failure and wear.

Moreover, the suction modules of the fluid end portions of many high-pressure reciprocating pumps require cross-bores, which intersect the pump cylinder, to deliver and carry away the process fluid. These intersecting cross-bores create stress concentrations, and thus further contribute to fatigue failure of the suction modules of the fluid end portions of such pumps. Thus, many known fluid end portions require high-strength materials in an attempt to avoid fatigue failure. U.S. Pat. No. 3,260,217 to Thresher, for example, discloses a typical fluid end portion having intersecting cross-bores.

Moreover, because of high pump pressures, leakage from such pumps becomes a problem when the valves begin to wear. Some known pumps use the pressure of the process fluid to hydrostatically bias the valve assembly in engagement with the connector block or cylinder. These pumps require heavy discharge manifolds to contain the high pressure encountered and are still susceptible to fatigue failure and wear. The weight and bulk of these discharge manifolds requires more than one person to remove the manifold for repair of the fluid end portion of the pump. Such configurations are therefore labor-intensive, time-consuming, and result in expensive downtime of the fluid pump. Since the repairs must be made at the site of the fluid pump, and thus at the sight of down-hole operations and so on, exposure to adverse weather conditions further contributes to the difficulties associated with removal and replacement of the worn or broken parts.

It would therefore be desirable to provide a fluid end portion that reduces the operating stresses of the suction module of the fluid end portion of high-pressure reciprocating pumps to thereby overcome one or more of the aforementioned disadvantages of the prior art.

BRIEF SUMMARY OF THE INVENTION

According to one aspect of the invention, a fluid end assembly for use in a high pressure reciprocal pump includes a discharge valve module having a discharge block with a first discharge bore fluidly connectable to a second discharge bore; and a suction valve module having a suction block connectable to the discharge block with a first suction bore fluidly connectable to the first discharge bore and a second suction bore fluidly connectable to the first suction bore. The first suction bore has a first suction bore section that matches the shape of the first discharge bore for coupling therewith. A second suction bore section has a different shape from the first suction bore section to thereby reduce stress in the suction valve module during use.

According to a further aspect of the invention, a suction block for use in a fluid end assembly includes a first suction bore extending from a first face of the suction block and into the interior thereof; and a second suction bore extending from a second face of the suction block and into the interior thereof to intersect the first suction bore. The second suction bore is adapted to receive a valve assembly for alternatively fluidly connecting and disconnecting the first and second suction bores. The first suction bore has a first suction bore section with a first geometry and a second suction bore section with a second geometry different from the first geometry to thereby reduce stress in the suction block during use.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

Figure 1:
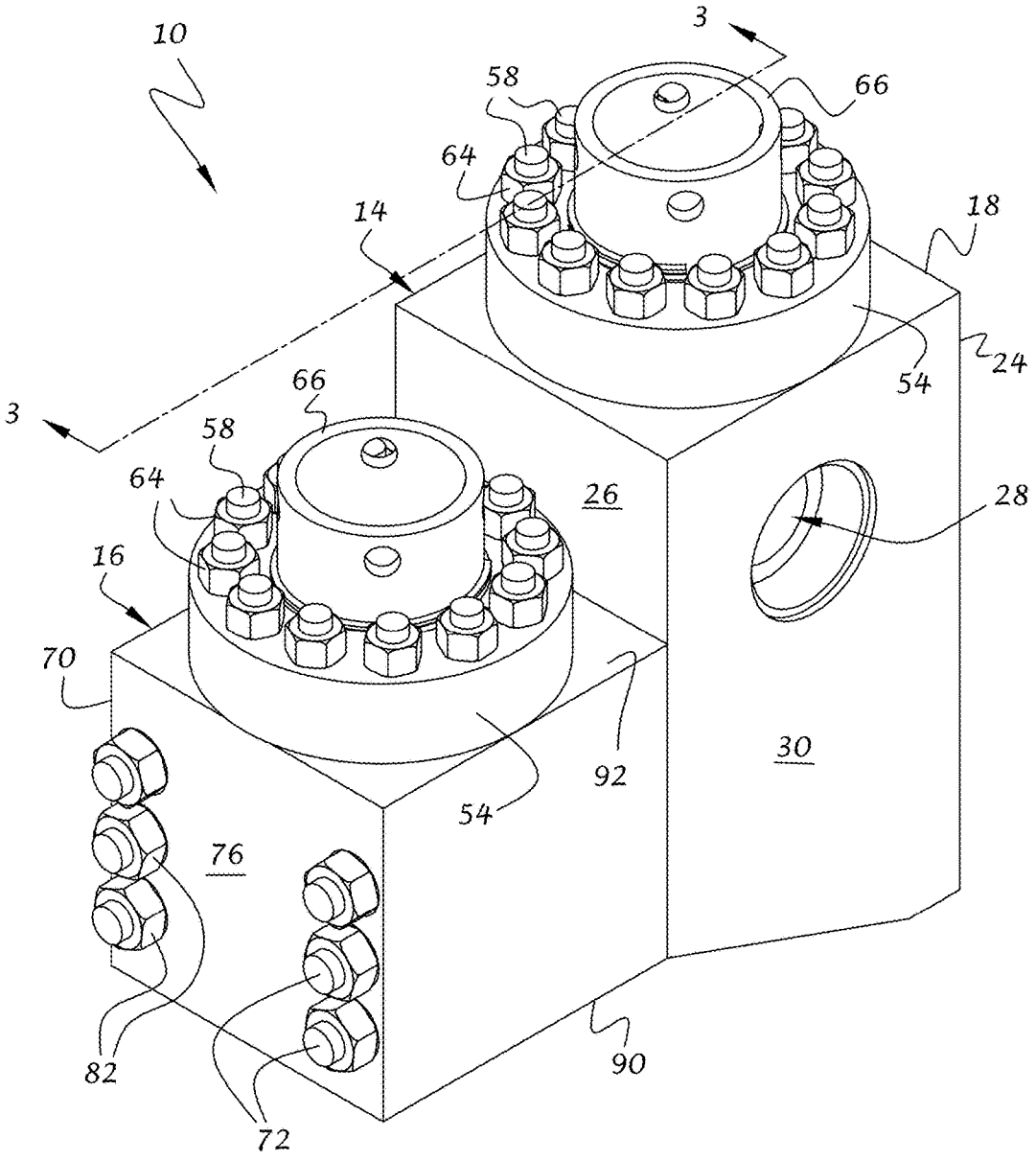
FIG. 1 is a front isometric view of a fluid end portion in accordance with the invention that forms part of a high pressure reciprocal pump.
Figure 2:
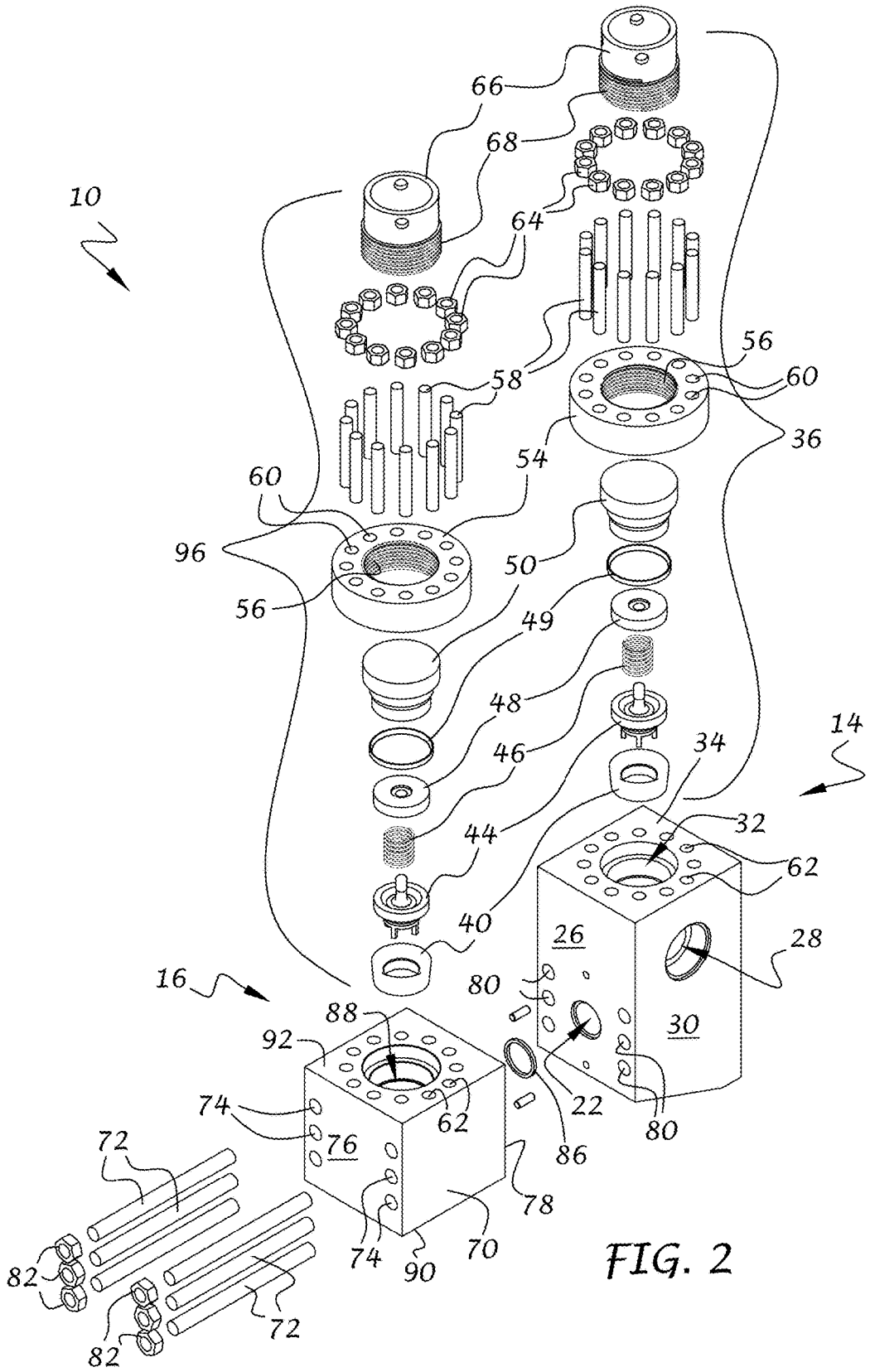
FIG. 2 is an exploded front isometric assembly view thereof.
Figure 3:
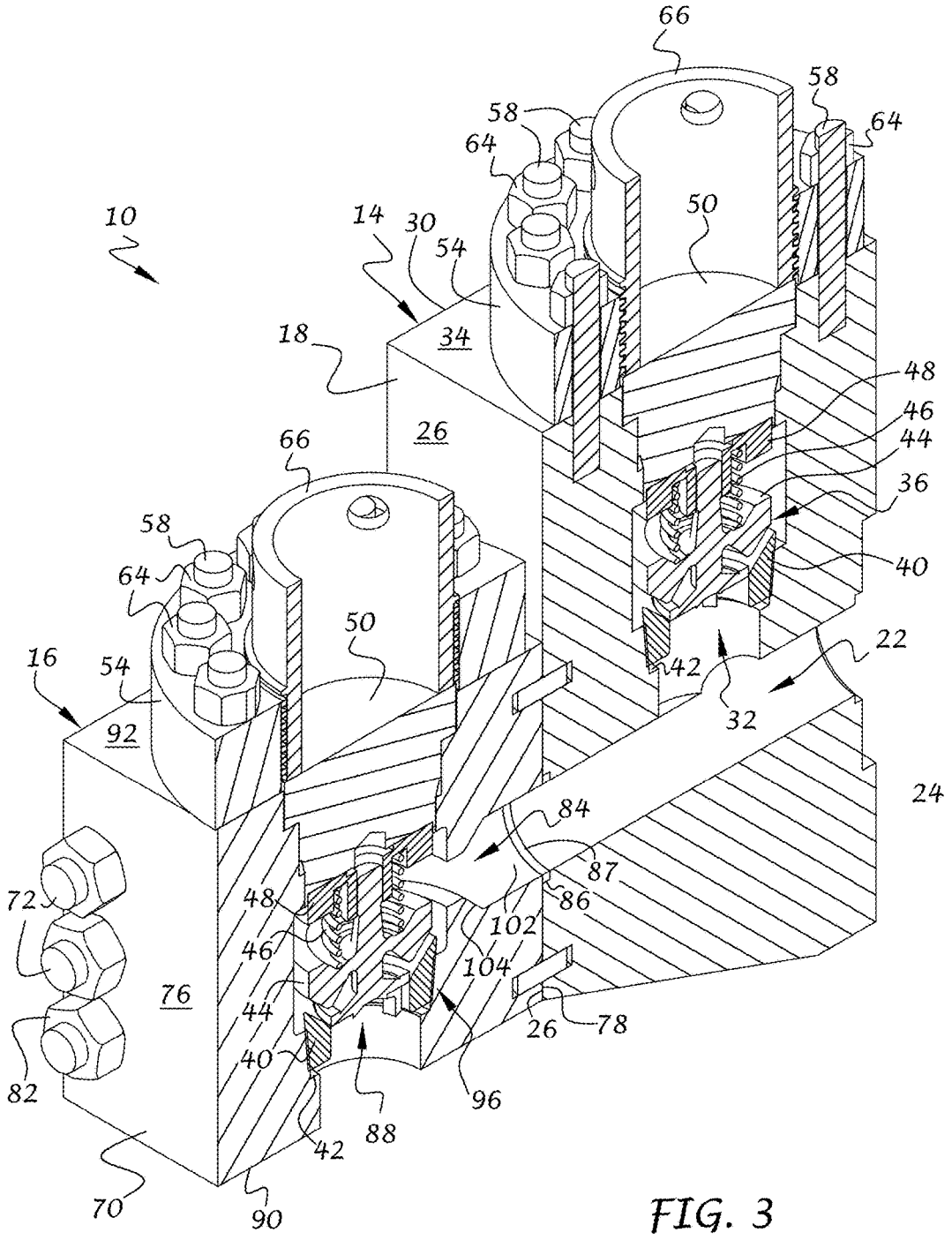
FIG. 3 is an isometric sectional view thereof taken along line 3-3 of FIG. 1.
Figure 4:
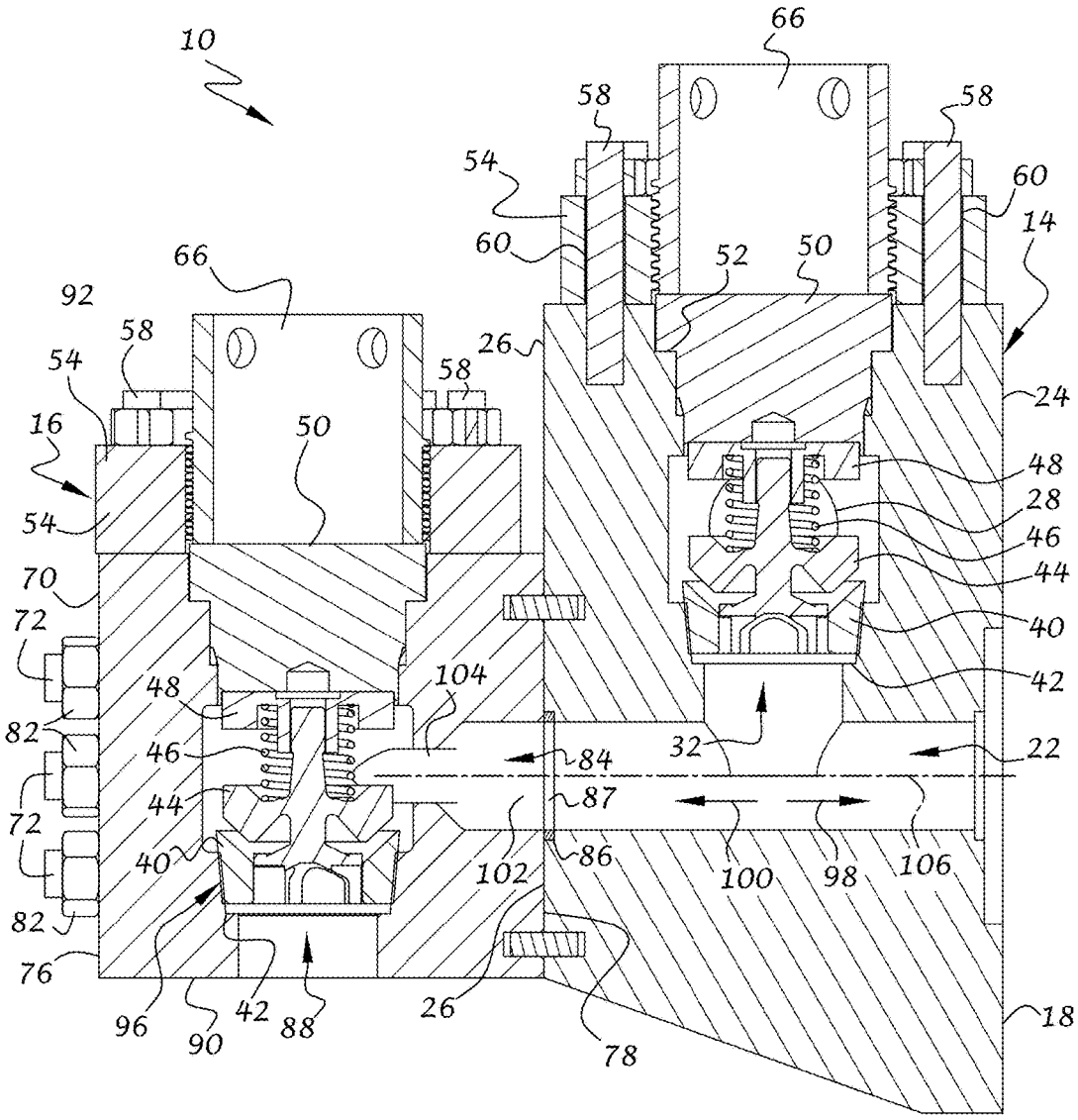
FIG. 4 is similar to FIG. 3 showing an elevational isometric sectional view thereof.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Referring to the drawings, and to FIGS. 1-4 in particular, a fluid end assembly 10 that forms part of a high-pressure reciprocating pump is illustrated. A typical, high-pressure, reciprocating fluid pump comprises two major assemblies, namely a power end assembly (not shown), and a fluid end assembly, which is the subject matter of the present invention. The fluid end assembly 10 is connected to the power end assembly in a well-known manner for driving a reciprocating plunger (not shown) associated with the fluid end assembly 10 for transporting liquids with high solid content from one location to another. Such power end assemblies are well known in the art and therefore will not be further elaborated on.

The fluid end assembly 10, in accordance with the invention, preferably includes a fluid discharge module 14 and a suction module 16 connected to the fluid discharge module 14.

As shown, the fluid discharge module 14 preferably includes a single-piece block 18 which can be formed by a single forging and/or machined from a block of high strength alloy or other suitable materials. The fluid discharge module 14 typically includes a first discharge bore 22 extending between a first face 24 and a second opposing face 26 and is operatively associated with a reciprocating plunger (not shown) in a well-known manner for receiving fluid being pumped through the suction valve module 16. The fluid is pumped through a second transverse discharge bore or port 28 that extends inwardly from a third face 30 (FIG. 1). The second bore 28 preferably extends at approximately 90 degrees with respect to the first bore 22 and is in fluid communication with the first bore 22.

In accordance with a further embodiment of the invention, although a single first bore, second bore, suction module, and discharge module are shown, it will be understood that the fluid discharge block 18 can have a plurality of first bores 22 formed therein operatively associated with an equal number of reciprocating plungers and each being in fluid communication with a separate suction module 16. For example, typical high-pressure, reciprocating fluid pumps may have a plurality of cylinders, such as three or five cylinders. Such pumps are referred to as triplex or quintuplex pumps, respectively. Accordingly, it will be understood that the present invention is not limited to a single fluid transfer configuration.

The fluid discharge module 14 further includes a discharge valve bore formed in the fluid discharge block 18 between a fourth face 34 (that is generally perpendicular to the first, second and third faces of the block 18) and the first discharge bore 22 and a discharge valve assembly 36 installed in the discharge valve bore 32. The discharge valve assembly 36 opens when the plunger (not shown) applies pressure to the fluid in the first bore 22 to thereby open a fluid passageway between the first bore 22 and the second bore 28 for discharging the fluid under pressure.

The discharge valve assembly 36 is preferably of the mechanically actuated type, but it will be understood that any suitable valve assembly can be used, including other mechanical and/or electronic valve assemblies. In the present exemplary embodiment, the discharge valve assembly 36 includes a discharge valve seat 40 is positioned in the discharge valve bore 32 against a shoulder 42 formed in the bore 32. A discharge valve 44 is also positioned in the discharge valve bore 32 and is normally biased against the valve seat 40 by a compression spring 46 that extends between the valve 44 and an upper valve guide 48 in a well-known manner to prevent reverse flow of fluid through the discharge valve bore 32 during the outward or "suction" stroke of the plunger (not shown). The upper valve guide 48 is preferably positioned in the discharge valve bore 32 and connected to an end cap 50 which is in turn positioned within the bore 32 and rests against an upper shoulder 52 formed in the bore 32. An O-ring or similar seal 49 is located between the bore 32 and the end cap 50 for sealing the valve assembly 40 to the block 18 in a well-known manner. A locking ring 54 with a central internally threaded bore 56 is mounted to the face 34 of the block 18. Threaded studs 58 extend through circumferentially spaced openings or bores 60 and thread into internally threaded circumferentially spaced bores 62 formed in the face 34 of the block 18. Nuts 64 thread onto the studs 58 and press against the locking ring 54 for holding the valve assembly 36 together in the bore 32. A sleeve 66 with external threads 68 is threaded into the bore 56 of the locking ring 54 in a well-known manner. The particular construction of the discharge valve assembly 36 does not form part of the present invention other than illustrating how the fluid end assembly 10 will function during operation. Accordingly, the fluid discharge module 14 as well as the discharge valve assembly 36 can be provided in a wide variety of shapes, configurations, and operating modes without departing from the spirit and scope of the invention.

With reference now to FIGS. 2-6, the suction module 16 preferably includes a single piece suction valve block 70 which can be formed by a single forging and/or machined from a block of high strength alloy or other suitable materials. The suction valve block 70 is preferably mounted to the second face 26 of the fluid discharge block 18 via six threaded studs 72 (best shown in FIG. 2) that extend through an equal number of openings or bores 74 extending through the block 70 between a first face 76 and opposing second face 78, then thread into an equal number of threaded openings or bores 80 formed in the second face 26 of the fluid discharge block 18 such that the second face 26 of the discharge block 18 abuts the second face 78 of the suction block 70 (best shown in FIGS. 3 and 4). Nuts 82 thread onto the studs 72 to securely fasten the suction valve block 70 to the fluid discharge block 18. It will be understood that more or less studs and/or other connection means can be used without departing from the spirit and scope of the invention. It will be further understood that the suction valve block 70 can be mounted to the fluid discharge block 18 through other connecting means, such as mutually engaging locking surfaces, retaining rings, clamps, or other well-known connection means, without departing from the spirit and scope of the invention.

A first suction bore 84 extends into the block 70 from the second face 78 and is coaxial with the first discharge bore 22 of the discharge block 18. An annular seal 86 is located in an annular groove 87 (FIG. 3) formed in the second face 26 of the discharge block 18. The annular seal 86 presses against the second face 78 of the fluid suction block 70 to thereby seal the first suction bore 84 to the first discharge bore 22. A second suction bore 88 extends into the suction block 70 between a third face 90 and a fourth face 92 of the block 70. The second suction bore 88 preferably extends at an angle of approximately 90 degrees with respect to the first suction bore 84 and is in fluid communication therewith.

The fluid suction module 16 further includes a suction valve assembly 96 installed in the second suction valve bore 88. The suction valve assembly 96 is similar in construction to the discharge valve assembly 36 and thus has similar numerals denoting similar parts. Accordingly, the details of the suction valve assembly 96 will not be further discussed.

Figure 10:
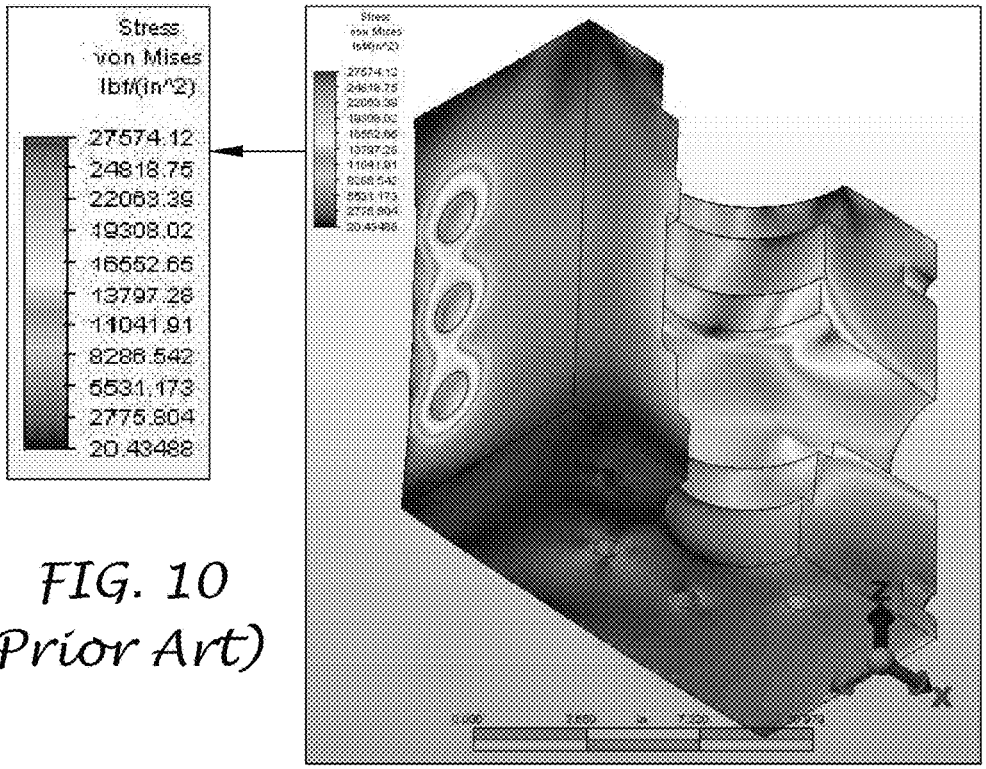
FIG. 10 (Prior Art)
FIG. 10 is an isometric sectional view similar to FIG. 8A showing stress analysis of a prior art suction module.

The suction valve assembly 96 opens when the plunger (not shown) applies suction to the fluid in the first discharge bore 22 of the discharge block 18 and in the first suction bore 84 of the suction block 70 to thereby open a fluid passageway between the second suction bore 88 and the first discharge bore 22 for receiving more fluid under vacuum pressure that is subsequently discharged through the second discharge bore 28 when the plunger (not shown) is moved in the opposite direction. Thus, when the plunger (not shown) moves to cause fluid travel to the right, as denoted by arrow 98 in FIG. 7, the suction valve opens and the discharge valve remains closed. When the plunger (not shown) moves to cause fluid travel to the left, as denoted by arrow 100 in FIG. 4, the suction valve closes under positive pressure and the discharge valve opens under the positive pressure to discharge the fluid through the discharge port 28. During this cyclical movement, the stress exerted on the inner faces of the bores of prior art suction modules can be upwards of 27 Kpsi, as shown in FIG. 10, especially at the 90 degree transition area 2 (FIGS. 8A and 8B) of a prior art suction block 4 between a first suction bore 6 and a second suction bore 8 thereof, thus resulting in early failure of the fluid suction module and/or components of the fluid suction module, such as the suction valve assembly.

Figure 5:
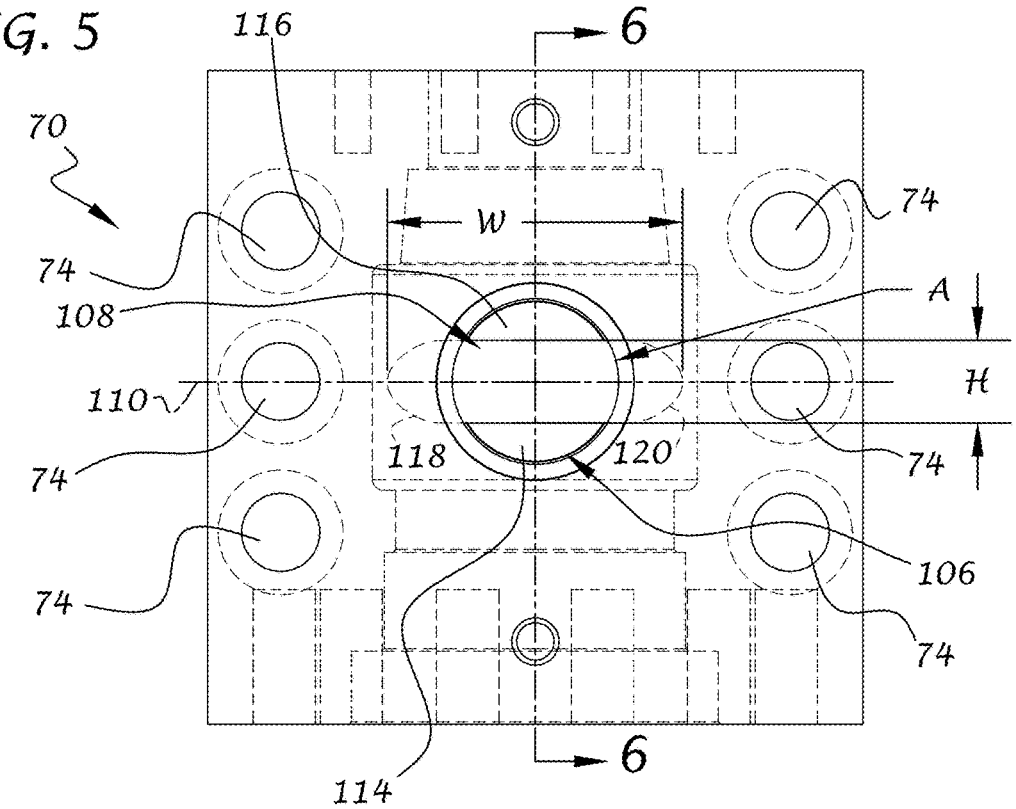
FIG. 5 is a side elevational view of a suction module in accordance with the invention that forms part of the fluid end portion.
Figure 6:
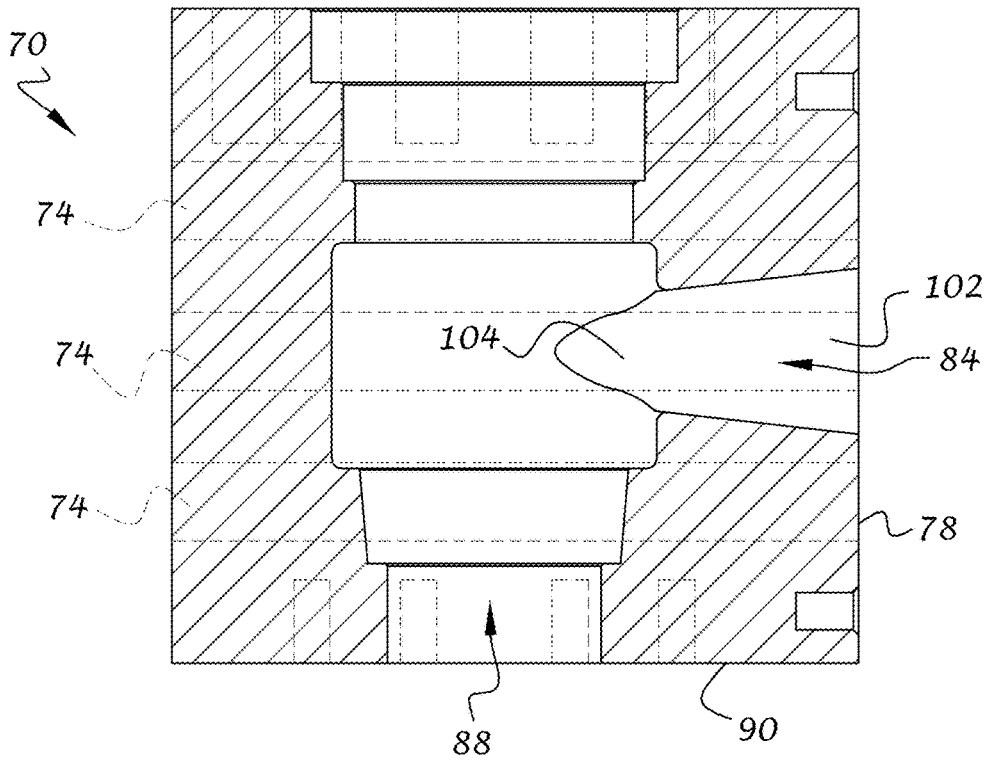
FIG. 6 is a sectional view taken along line 6-6 of FIG. 5 and showing an further embodiment of the suction module.
Figure 7A:
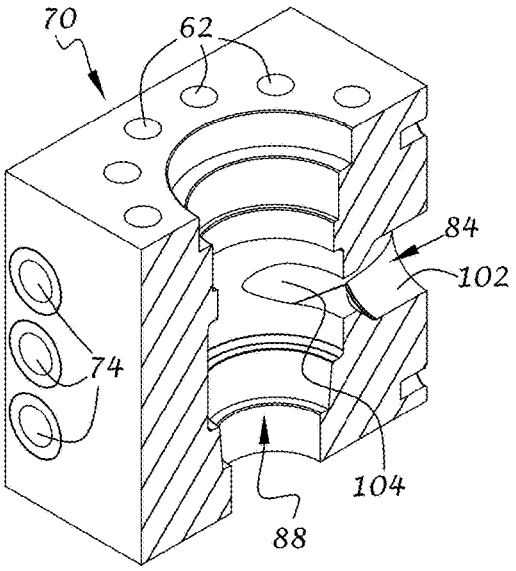
FIG. 7A is an isometric sectional view similar to the FIG. 6 cross-section.
Figure 7B:
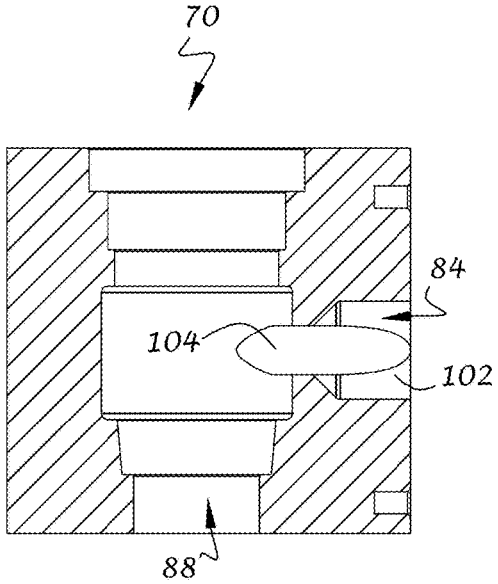
FIG. 7B is a sectional view similar to FIG. 6 with the hidden lines removed.
Figure 8A:
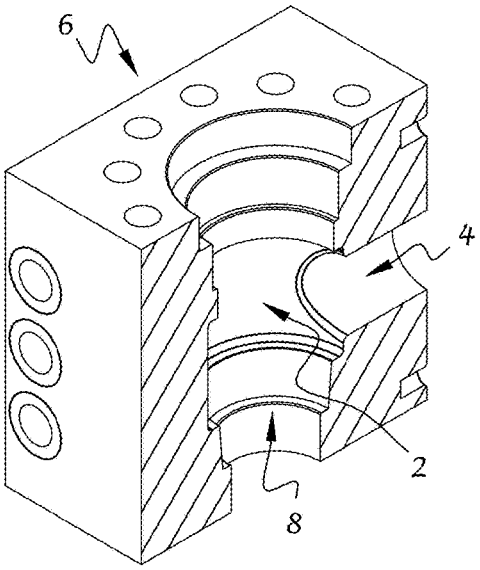
FIG. 8A (Prior Art)
FIG. 8A is an isometric sectional view of a prior art suction module.
Figure 8B:
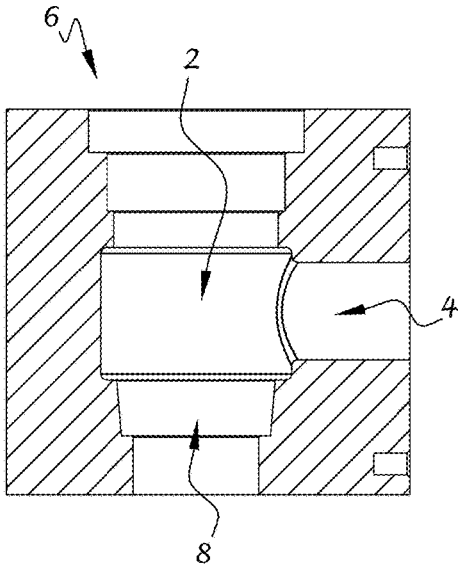
FIG. 8B (Prior Art)
FIG. 8B is a rear sectional view similar to the FIG. 8 cross-section.

In order to reduce the amount of cyclic stress on the inner walls of the suction module 16 and in accordance with the invention, as best shown in FIGS. 5-7, the first suction bore 84 preferably includes a first suction bore section 102 that has a circular cross sectional area 106 and a second suction bore section 104 that has a slotted cross sectional area 108 that is longer than the diameter of the circular area along an axis 110 and narrower than the diameter of the circular area along an axis 112.

As shown in FIG. 6, and in accordance with a further embodiment of the invention, the first bore section 102 converges smoothly towards the second suction bore 88. A lower shoulder 114 and an upper shoulder 116 of the first suction bore 84 define a transition area between the first bore section 102 and second bore section 104. At the face 78 of the suction block 70, the first suction bore section 102 is preferably of the same size and circular shape as the first discharge bore 22 of the discharge block 18 so that the bores mate together.

Figure 9:
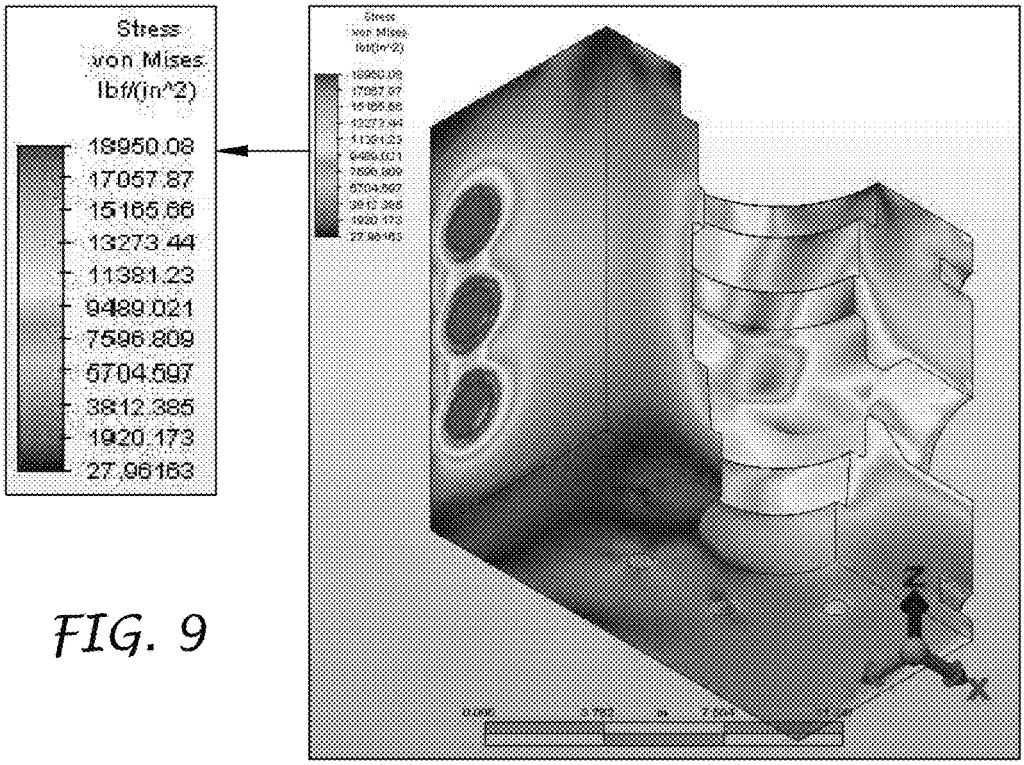
FIG. 9 is an isometric sectional view similar to FIG. 7A showing stress analysis of the suction module of the invention.

In accordance with an exemplary embodiment of the invention, the suction bore 88 may be seven inches in diameter while the discharge bore 22 may be four inches in diameter. The first suction bore section 102 would have a dimension "A" (FIG. 5) of four inches in diameter to match the size and shape of the discharge bore 22. The slotted portion 108 of the second suction bore section 104 would have a height "H" of approximately two inches, for example, and a width "W" of about seven inches long, for example, including the radiused ends 118 and 120 (FIG. 5). Preferably, the cross sectional area of the slotted portion 108 is at least approximately equal to the cross sectional area of the first suction bore section 102, and thus the first discharge bore 22. In this manner, the block 70 has additional material where the highest stresses are located without impeding the flow of the liquid slurry. As best shown in FIG. 9, in accordance with the exemplary embodiment of the invention, the maximum stress experienced by the suction block 70 is approximately 19 kpsi, which is a significant reduction in stress over the prior art.

It will be understood that the size and shape of the slotted portion 108 as well as the size and shape of the internal bores can have a great amount of variance without departing from the spirit and scope of the invention.

Accordingly, the varying width of the first suction bore 84 reduces the operating stress of the suction module 16 in the fluid end 10 of a pump by forming a tangential intersection (see FIG. 7) of the second suction bore 88 and the first suction bore 84. Another benefit of the varying width suction bore 88 is increased reinforcement near the areas of highest stress. Yet another benefit of the varying width suction bore 88 is reduced pump shut down time due to maintenance, as the life of the suction module 16 is increased. A further benefit of the varying width suction bore 88 is improved fluid dynamics. Yet a further benefit of the suction module 16 is that it can be easily removed from the discharge module 14 by removing the six nuts 82 and sliding the suction module 16 off the studs 72 and replaced by another suction module 16 by sliding the new module over the studs 72 and installing the nuts 82 thereon.

It will be understood that the term "preferably" as used throughout the specification refers to one or more exemplary embodiments of the invention and therefore is not to be interpreted in any limiting sense. It will be further understood that the term "connect" and its various derivatives as may be used throughout the specification refer to components that may be joined together either directly or through one or more intermediate members. In addition, terms of orientation and/or position as may be used throughout the specification relate to relative rather than absolute orientations and/or positions.

It will be appreciated by those skilled in the art that changes could be made to the embodiments described above without departing from the broad inventive concept thereof. For example, the suction block and the discharge block can be made by forging and/or machining from a single block of material. Moreover, the transition from the slotted bore section 104 to the round bore section 102 need not occur only in the suction module. The transition could take place in the discharge module by modifying the bore 22 and removing the round bore section 102. Furthermore, the same geometry as disclosed herein may be employed in any high pressure environment where fluid and/or slurry must pass through a bend or elbow to thereby reduce the stresses on the surrounding structure. It will be understood, therefore, that this invention is not limited to the particular embodiments disclosed, but is intended to cover modifications within the spirit and scope of the present invention as defined by the appended claims.

What is claimed:

1. A fluid end assembly for use in a high pressure reciprocal pump for pumping liquid slurry therethrough, the fluid end assembly comprising:

a discharge valve module having a discharge block with a first discharge bore fluidly connectable to a second discharge bore;

a discharge valve assembly positioned between the first and second discharge bores;

a suction valve module having a suction block connectable to the discharge block, and including a first suction bore fluidly connectable to the first discharge bore and a second suction bore fluidly connectable to the first suction bore;

a suction valve assembly positioned between the first and second suction bores;

the first discharge bore and first suction bore being connected together in mating relationship when the discharge valve module and suction valve module are connected together;

a first suction bore section comprising a first portion of the first suction bore in the suction block, the first suction bore section having a first shape that is circular in cross section for matching a circular cross-sectional shape of the first discharge bore at an intersection of the first discharge bore and first suction bore so that the first discharge bore is fluidly connected to the first suction bore when the discharge block and suction block are connected together; and a second suction bore section comprising a second portion of the first suction bore in the suction block, the second suction bore section being separated from the first discharge bore by the first suction bore section, the second suction bore section having a second slotted cross-sectional shape that is longer than the diameter of the first circular cross-sectional shape of the first suction bore section along a first axis and narrower than the diameter along a second axis perpendicular to the first axis to thereby provide additional material where highest stresses occur along the first suction bore without impeding flow of the liquid slurry therethrough to thereby reduce stress in the suction valve module due to contact between an inner face of the second suction bore section and the liquid slurry being pumped under pressure during use.

2. A fluid end assembly according to claim 1, wherein the first and second bore sections with their respective first and second cross-sectional shapes are formed only in the first suction bore.

3. A fluid end assembly according to claim 1, wherein the second suction bore section tangentially intersects the second suction bore to thereby reduce operating stress in the suction valve module.

4. A fluid end assembly according to claim 1, wherein the first suction bore varies in width from the second cross-sectional shape of the first suction bore section toward the third cross-sectional shape of the second suction bore section.

5. A fluid end assembly according to claim 1, wherein the first suction bore converges from the circular cross-sectional shape of the first suction bore section toward the slotted cross-sectional shape of the second suction bore section along the second axis, and the first suction bore diverges from the circular cross-sectional shape toward the slotted cross-sectional shape along the first axis to thereby provide the additional material along the second axis.

6. A fluid end assembly according to claim 1, and further comprising a ramped transition area between the first cross-sectional shape of the first suction bore section and the second cross-sectional shape of the second suction bore section.

7. A fluid end assembly for use in a high pressure reciprocal pump for pumping liquid slurry, the fluid end assembly comprising:

a discharge valve module having a discharge block with a first discharge bore fluidly connectable to a second discharge bore via a first valve assembly the first discharge bore having a first circular cross-sectional shape with a first diameter defining a first area;

a suction valve module having a suction block connectable to the discharge block with a first suction bore fluidly connectable to the first discharge bore and a second suction bore fluidly connectable to the first suction bore via a second valve assembly;

a first suction bore section comprising a first portion of the first suction bore, the first suction bore section having a second circular cross-sectional shape with a second diameter defining a second area that matches the first diameter and first area respectively of the first circular cross-sectional shape of the first discharge bore at an intersection of the first discharge bore and the first suction bore section so that the first discharge bore and first suction bore mate when the discharge block and suction block are connected together; and a second suction bore section comprising a second portion of the first suction bore, the second suction bore section being separated from the first discharge bore by the first suction bore section, the second suction bore section having a third cross-sectional shape that is different from the first circular cross-sectional shape and the second circular cross-sectional shape to thereby reduce stress in the suction valve module due to contact between an inner face of the second suction bore section and the liquid slurry being pumped under pressure during use;

the third cross-sectional shape being slot-shaped with a width that is longer than the first and second diameters of the first and second circular cross-sectional shapes, respectively, and a height that is narrower than the first and second diameters to thereby define a third cross-sectional area and provide additional material in the second suction bore section where highest stresses occur due to contact between the second suction bore section and the liquid slurry when pumped under pressure during use;

wherein the third cross-sectional area is at least approximately equal to the second cross-sectional area of the second cross-sectional shape so that the flow of liquid slurry through the first suction bore is unimpeded.

8. A fluid end assembly for use in a high pressure reciprocal pump for transferring liquid slurry under pressure therethrough, the fluid end assembly comprising:

a discharge valve module having a discharge block with a first discharge bore fluidly connectable to a second discharge bore via a first valve assembly located therebetween, with the first discharge bore being perpendicular to the second discharge bore and having a first circular cross-sectional shape defining a first area;

a suction valve module having a suction block connectable to the discharge block with a first suction bore fluidly connectable to the first discharge bore and a second suction bore fluidly connectable to the first suction bore via a second valve assembly located therebetween, with the first suction bore being perpendicular to the second suction bore;

a first suction bore section comprising a first portion of the first suction bore, the first suction bore section having a second circular cross-sectional shape defining a second area that match the first circular cross-sectional shape and first area, respectively, of the first discharge bore at an intersection of the first discharge bore and first suction bore so that the first discharge bore and first suction bore mate when the discharge block and suction block are connected together; and a second suction bore section comprising a second portion of the first suction bore closest to the second valve assembly, the second suction bore section having a third cross-sectional shape defining a third area, the third cross-sectional shape being different from the first and second cross-sectional shapes, to thereby provide additional material in the second suction bore section where highest stresses occur due to contact between the second suction bore section and the liquid slurry when pumped under pressure during use and reduce stress in the suction valve module;

wherein the second cross-sectional area is at least approximately equal to the third cross-sectional area of the third cross-sectional shape.

9. A fluid end assembly for use in a high pressure reciprocal pump, the fluid end assembly comprising:

a discharge valve module having a discharge block with a first discharge bore fluidly connectable to a second discharge bore via a first valve assembly located therebetween, the second discharge bore having a first cross-sectional shape defining a first cross-sectional area;

a suction valve module having a suction block connectable to the discharge block with a first suction bore fluidly connectable to the first discharge bore and a second suction bore fluidly connectable to the first suction bore via a second valve assembly located therebetween;

a first bore section comprising a first portion of the first suction bore and at least a portion of the first discharge bore, the first bore section having a second cross-sectional shape defining a second cross-sectional area that match the first cross-sectional shape and the first cross-sectional area of the discharge bore at least at an intersection of the first discharge bore and first suction bore so that the first discharge bore and first suction bore mate when the discharge block and suction block are connected together; and a second bore section comprising a second portion of the first suction bore closest to the second valve assembly, the second bore section having a third cross-sectional shape defining a third area, the third cross-sectional shape being different from the second cross-sectional shape to thereby provide additional material in the second suction bore section where highest stresses occur due to contact between the second suction bore section and the liquid slurry when pumped under pressure during use and reduce stress in the suction valve module;

wherein the first suction bore section varies in width from the second cross-sectional shape toward the third cross-sectional shape.

10. A fluid end assembly according to claim 9, wherein the first cross-sectional shape comprises a circle with a first diameter and the third cross-sectional shape comprises an oblong slot having a first length and a first height;

wherein the first length is longer than the first diameter of the first cross-sectional shape along a first axis and the first height is narrower than the first diameter along a second axis perpendicular to the first axis to thereby provide additional material where highest stresses occur along the first suction bore.

11. A fluid end assembly according to claim 10, wherein the first diameter of the circle is approximately four inches and the first length and height of the oblong slot are approximately seven inches and two inches, respectively.

12. A fluid end assembly according to claim 10, wherein the oblong slot comprises a straight section with radiused ends.

13. A suction block for use in a fluid end assembly of a high pressure reciprocal pump for transferring liquid slurry under pressure therethrough, the suction block comprising:

a first suction bore extending from a first face of the suction block and into the interior thereof;

a second suction bore extending from a second face of the suction block and into the interior thereof to intersect the first suction bore;

the first suction bore having a first suction bore section with a first circular cross-sectional shape defining a first cross-sectional area for mating with a discharge bore of a discharge block when the discharge block and suction block are connected together, the first cross-sectional shape having a first diameter; and the first suction bore having a second suction bore section with a second slotted cross-sectional shape defining a second cross-sectional area, the second cross-sectional shape being longer than the first diameter of the circular cross-sectional shape of the first suction bore section along a first axis and narrower than the first diameter along a second axis perpendicular to the first axis to thereby provide additional material where highest stresses occur along the first suction bore and reduce stress in the suction block due to contact between an inner face of the second bore section and fluid being pumped under pressure during use.

14. A suction block according to claim 13, wherein the second suction bore section tangentially intersects the second suction bore.

15. A suction block according to claim 13, wherein the second slotted cross-sectional area of the second suction bore section is approximately equal to the first circular cross-sectional area of the first suction bore section to thereby reduce stress in the suction block without impeding flow of the liquid slurry therethrough.

16. A suction block according to claim 13, wherein the first suction bore section varies in width toward the second suction bore section.

17. A suction block according to claim 13, and further comprising a suction valve assembly positioned between the first and second suction bores.

* * * * *